United States Patent [19]

Scarnera

[11] Patent Number: 4,967,718

[45] Date of Patent: Nov. 6, 1990

[54] IGNITION SYSTEM FOR AN INTERNAL COMBUSTION ENGINE USING THYRISTORS

[75] Inventor: Michele Scarnera, Turin, Italy

[73] Assignee: Marelli Autronica S.p.A., Milan, Italy

[21] Appl. No.: 440,176

[22] Filed: Nov. 22, 1989

[30] Foreign Application Priority Data

Nov. 23, 1988 [IT] Italy ..... 68045 A/88

[51] Int. Cl.[5] ..... F02P 3/06

[52] U.S. Cl. ..... 123/605; 123/604; 123/594

[58] Field of Search ..... 123/665, 600, 594, 596, 123/602, 620

[56] References Cited

U.S. PATENT DOCUMENTS

| | | | |
|---|---|---|---|
| 4,455,989 | 6/1984 | Endo et al. | 123/605 |
| 4,480,624 | 11/1984 | Anderson | 123/605 |
| 4,515,140 | 5/1985 | Enomoto et al. | 123/605 |
| 4,886,036 | 12/1989 | Johansson et al. | 123/596 |

*Primary Examiner*—Raymond A. Nelli

*Attorney, Agent, or Firm*—Sughrue, Mion, Zinn, MacPeak & Seas

[57] ABSTRACT

An ignition system for an internal combustion engine comprises a direct-current supply, at least one spark plug, an ignition coil with a primary winding and a secondary winding for connection to the supply and to the at least one plug, respectively, a first electronic switch between the primary winding and the supply, an inductor between the supply and the primary winding of the coil, a capacitor in parallel with the circuit branch including the primary winding and the first switch, a second electronic switch between the inductor and the supply and adapted to disconnect the circuit downstream of the inductor from the supply in its closed condition, and an electronic unit which controls the first and second switches in a predetermined manner. The first switch is constituted by a thyristor and, when the current flowing in the thyristor is to be cut off, the electronic control unit closes the second electronic switch and then reopens it after a time sufficient to allow the current flowing in the thyristor to fall below a predetermined value.

2 Claims, 2 Drawing Sheets

IGNITION SYSTEM FOR AN INTERNAL COMBUSTION ENGINE USING THYRISTORS

The present invention relates to an ignition system for an internal combustion engine of the type defined in the introduction to the appended claim 1.

Figure 1:
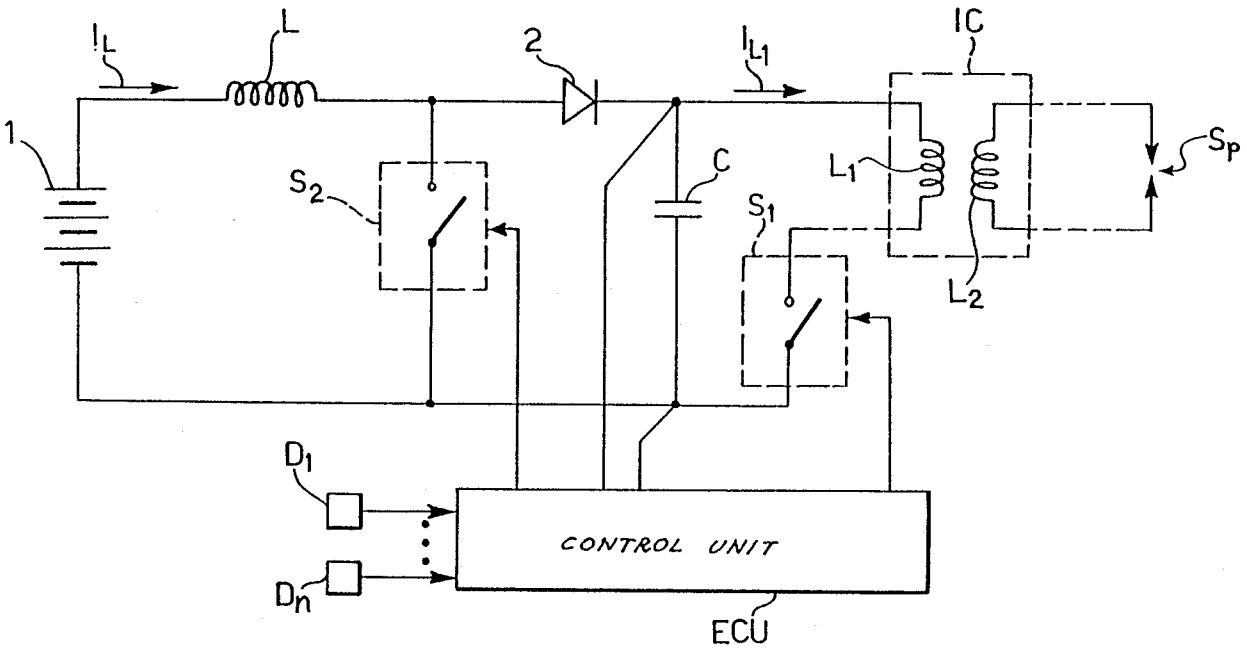

An ignition system of this type is illustrated schematically in FIG. 1 of the appended drawings, in which a low-voltage direct-current supply is indicated 1, an ignition coil is indicated IC and has a primary winding $L_1$ and a secondary winding $L_2$, and a spark plug is indicated SP.

The positive pole of the supply 1 is connected to one end of the inductor L the other end of which is connected to the anode of a diode 2 whose cathode is connected to the winding $L_1$ of the coil. An electronic switch ($S_1$) is arranged in series with this winding. A capacitor C is connected in parallel with the circuit branch including $L_1$ and $S_1$. A second electronic switch $S_2$ is connected between the inductor L and the negative pole of the supply 1.

The operation of the ignition system illustrated is controlled by an electronic unit ECU formed, for example, with the use of a microprocessor, on the basis of data from sensors $D_1$-$D_n$ which provide signals indicative of the operation of the engine. The unit ECU controls the operation of the system by means of the switches $S_1$ and $S_2$.

Two possible modes of operation of the system illustrated in FIG. 1 are described in detail in a previous patent application filed in the name of the same Applicant.

According to the prior art, the switches $S_1$ and $S_2$ are constituted by transistors or by MOSFET-type solid-state devices. The use of transistors, particularly for the switch $S_1$, is not entirely satisfactory: in fact, transistors have problems of reliability since usually they cannot easily withstand the passage of bursts of high-intensity current such as those necessary for generating a spark.

The use of MOSFET-type devices for $S_1$ also involves some problems: this type of device has a certain resistance when it is conducting and this creates a time constant such as appreciably to slow down the discharge. Moreover, MOSFET-type devices are not generally adapted to withstand very high voltages.

From the point of view of reliability and performance, the device which would be most suitable for the electronic switch $S_1$ is a thyristor or SCR (silicon controlled rectifier). Such a device can be made conductive by the application of a signal to a control electrode (a gate electrode): once initiated, conduction can then continue, even in the absence of the control signal, until the current passing through the device falls below a certain value (the holding current). However, this latter characteristic means that the use of a thyristor for forming $S_1$ in the application illustrated in FIG. 1 is problematical. In fact, if $S_1$ is a thyristor and it is conductive ("closed") in a certain operating condition, it is necessary to be able to switch off the thyristor in order to cut off the current in $L_1$. However, this is impossible: in fact, when $S_1$ is conductive ("closed"), the current flowing therein is certainly very high (corresponding substantially to the ratio between the voltage delivered by the supply 1 and the ohmic resistance of L and $L_1$) and, in this situation, the current in $S_1$ cannot be reduced to a value below the holding value and $S_1$ cannot therefore be "opened".

For this reason, in spite of this greater reliability and improved performance, $S_1$ is formed by transistors or MOSFET devices in the prior art.

The object of the present invention is to provide an ignition system of the type indicated above which enables thyristors to be used for the (at least one) first electronic switch.

According to the invention, this object is achieved by means of an ignition system of the type specified above, whose main characteristics are defined in the appended claim 1.

Figure 2:
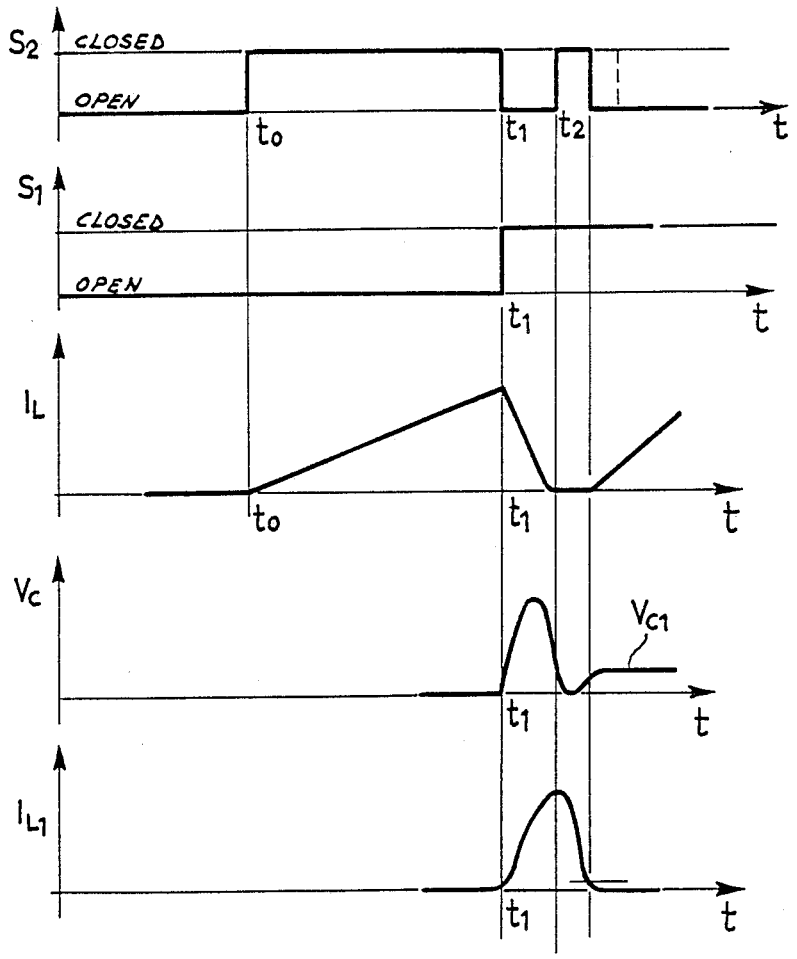

Further characteristics and advantages of the present invention will become clear from the detailed description which follows with reference to the appended drawings, provided by way of non-limiting example, in which:

FIG. 1, which has already been described, is a circuit diagram of an ignition system for an internal combustion engine shown partially in blocks, and FIG. 2 is a series of graphs showing the states of switches and signals generated in the ignition system of FIG. 1, produced according to the invention.

An ignition system according to the invention thus has the general layout shown in FIG. 1, in which the electronic switch (or electronic switches) $S_1$ is (are) constituted by a thyristor (thyristors).

In order to produce a spark in the plug SP, the unit ECU can first close $S_2$, as indicated at the time $t_0$ in FIG. 2, whilst $S_1$ remains open. Starting from this time, the current $I_L$ flowing in the inductor L increases in the manner shown. At a subsequent time $t_1$, the unit ECU opens $S_2$ and closes $S_1$; the inductor L is connected to the capacitor C and forms therewith a resonant circuit which is discharged into the primary winding $L_1$ of the ignition coil IC. As this happens, the current $I_L$ falls rapidly to zero, whilst the voltage $V_C$ across the terminals of the capacitor increases initially and then starts to decrease. There is a correspondingly rapid increase in the current $I_{L1}$ flowing in the primary winding $L_1$ of the ignition coil, as shown in FIG. 2.

In order to be able to cut off the thyristor which constitutes $S_1$, the unit ECU monitors the voltage across the terminals of C: as soon as this voltage is less than or at most equal to the difference between the voltage of the supply 1 and the fall in L and the diode 2, it closes $S_2$ again, as shown at the time $t_2$ in FIG. 2. The circuit downstream of $S_2$ is thus disconnected from the supply 1 and the capacitor C can be discharged rapidly into $L_1$. When the capacitor is practically discharged, the current flowing in $L_1$ and $S_1$ falls below the holding value and the thyristor constituting $S_1$ can therefore be cut off.

$S_2$ can be reopened by the unit ECU in two ways:

in a first mode, the unit ECU can monitor the intensity of the current $I_{L1}$ (by means of a current sensor of known type, not shown) and, when this intensity falls below a threshold value, $S_2$ can be closed, or the unit ECU can be arranged to open $S_2$ again once it has been closed for a predetermined, constant period of time, this period of time being determined so as to ensure that the current $I_{L1}$ falls below the value of the holding current of the thyristor in all operating conditions.

The closure of $S_2$ to switch off the thyristor used for $S_1$ has a further advantage: during the period when $S_2$ is closed, energy is stored in L and, once $S_2$ is reopened, this enables the capacitor C to be charged to a certain voltage (indicated $V_{c1}$) from which it can be charged more rapidly to the voltage necessary to ensure the production of the spark in the next operating cycle.

What is claimed is:

1. An ignition system for an internal combustion engine, including:

a low-voltage direct-current supply, at least one spark plug, an ignition coil with a primary winding and a secondary winding for connection to the supply and to the at least one plug, respectively, at least one first electronic switch between the primary winding of the coil and the supply for controlling the flow of current in the primary winding, an inductor between the supply and the primary winding of the coil, a capacitor in parallel with the circuit branch including the primary winding and the first electronic switch, a second electronic switch between the inductor and the supply and adapted to disconnect the circuit downstream of the inductor from the supply in its closed condition, and an electronic control unit arranged to control the first and second electronic switches in a predetermined manner, wherein the at least one first electronic switch is constituted by a thyristor and, in order to cut off the flow of current in the thyristor, the electronic control and operating unit is adapted to close the second electronic switch so as to disconnect the said circuit branch from the supply, and then to reopen the second switch after a time sufficient to allow the current flowing in the thyristor to fall below a predetermined value.

2. A system according to claim 1, wherein the electronic control unit is adapted to enable the reopening of the second switch after it has been closed for a predetermined time interval.

* * * * *